US006964146B2

(12) United States Patent
LaRocca

(10) Patent No.: US 6,964,146 B2
(45) Date of Patent: Nov. 15, 2005

(54) PORTABLE POUCH OPENING MACHINE

(75) Inventor: Terence LaRocca, Selden, NY (US)

(73) Assignee: Adaptive Manufacturing Technologies, Inc., Holbrook, NY (US)

( * ) Notice: Subject to any disclaimer, the term of this patent is extended or adjusted under 35 U.S.C. 154(b) by 36 days.

(21) Appl. No.: 10/442,695

(22) Filed: May 20, 2003

(65) Prior Publication Data

US 2004/0020170 A1 Feb. 5, 2004

Related U.S. Application Data

(60) Provisional application No. 60/382,056, filed on May 21, 2002.

(51) Int. Cl.[7] ..... B65B 41/06

(52) U.S. Cl. ..... 53/459; 53/573; 53/386.1

(58) Field of Search ..... 53/459, 570, 384.1, 53/572, 573, 386.1; 198/377.03, 377.04, 377.08, 468.4, 471.1, 803.5

(56) References Cited

U.S. PATENT DOCUMENTS

| | | | | | |
|---|---|---|---|---|---|
| 2,601,480 | A | * | 6/1952 | Williams | 53/370.2 |
| 2,732,988 | A | | 1/1956 | Feinstein | |
| 2,969,629 | A | | 1/1961 | Blais | |
| 2,973,612 | A | | 3/1961 | McGowan | |
| 3,225,515 | A | | 12/1965 | Inglett | |
| 3,243,937 | A | | 4/1966 | Ragan | |
| 3,495,378 | A | | 2/1970 | Kipers | |
| 3,750,721 | A | * | 8/1973 | Hudson | 141/10 |
| 3,851,751 | A | * | 12/1974 | Jones | 198/803.5 |
| 3,896,605 | A | | 7/1975 | Chevalier | 53/266 |
| 3,990,216 | A | | 11/1976 | Martin | 53/371 |
| 4,057,951 | A | | 11/1977 | Schneider | 53/55 |
| 4,078,358 | A | | 3/1978 | Henderson | 53/29 |
| 4,172,349 | A | | 10/1979 | Lipes | 53/459 |
| 4,342,219 | A | | 8/1982 | Stirling | 73/35 |
| 4,507,789 | A | | 3/1985 | Daly et al. | 372/92 |
| 4,509,313 | A | | 4/1985 | Koppe | 53/570 |
| 4,516,762 | A | * | 5/1985 | Moltrasio et al. | 271/11 |
| 4,554,776 | A | | 11/1985 | Chikatani | 53/76 |
| 4,577,454 | A | * | 3/1986 | Wright et al. | 53/492 |
| 4,617,785 | A | * | 10/1986 | Chikatani et al. | 53/562 |
| 5,140,801 | A | * | 8/1992 | Wild | 53/459 |
| 5,216,923 | A | | 6/1993 | Brett | 73/827 |
| 5,351,465 | A | | 10/1994 | Fortnam et al. | 53/492 |
| 5,442,898 | A | | 8/1995 | Gabree et al. | 53/459 |
| 5,467,578 | A | * | 11/1995 | Jensen | 53/469 |
| 5,582,284 | A | * | 12/1996 | Calladine et al. | 198/367 |
| 5,638,938 | A | * | 6/1997 | Lazzarotti et al. | 198/445 |
| 5,802,817 | A | | 9/1998 | Hood | 53/459 |
| 5,829,230 | A | * | 11/1998 | Hartz | 53/455 |
| 6,073,424 | A | * | 6/2000 | Kraft et al. | 53/570 |
| 6,138,817 | A | * | 10/2000 | Hjalmarsson et al. | 198/367.1 |
| 6,263,645 | B1 | | 7/2001 | Burford et al. | 53/468 |
| 6,318,051 | B1 | | 11/2001 | Preiss | 53/493 |
| 6,453,802 | B1 | | 9/2002 | Manganiello et al. | 99/330 |
| 6,490,030 | B1 | | 12/2002 | Gill et al. | 356/71 |
| 6,499,280 | B1 | * | 12/2002 | Tsutsui | 53/570 |
| 6,736,589 | B2 | * | 5/2004 | Sichera et al. | 414/737 |

* cited by examiner

*Primary Examiner*—John Paradiso
(74) *Attorney, Agent, or Firm*—Alfred M. Walker

(57) ABSTRACT

A portable pouch opener for countertop positioning for opening and filling a bag includes a portable housing positionable upon a desktop bench workspace. The housing has a magazine containing a supply of bags to be opened and filled. A first suction device is mounted for being moved into engagement with a bag in the magazine. The first suction device has a source of vacuum to activate the first suction device when placed into contact with one wall of the bag. Vacuum from the first suction device is withdrawn from the bag, attaching the bag to the first suction device, to remove the bag from the magazine and bring it to an opening position. An opposite facing wall of the bag is in contact with a second suction device having a source of vacuum, so that said opposite facing wall is engaged by said second suction device. Then the first suction device is retracted to separate the walls of the bag to produce an opening into the bag, allowing the bag to be filled and optionally sealed.

18 Claims, 8 Drawing Sheets

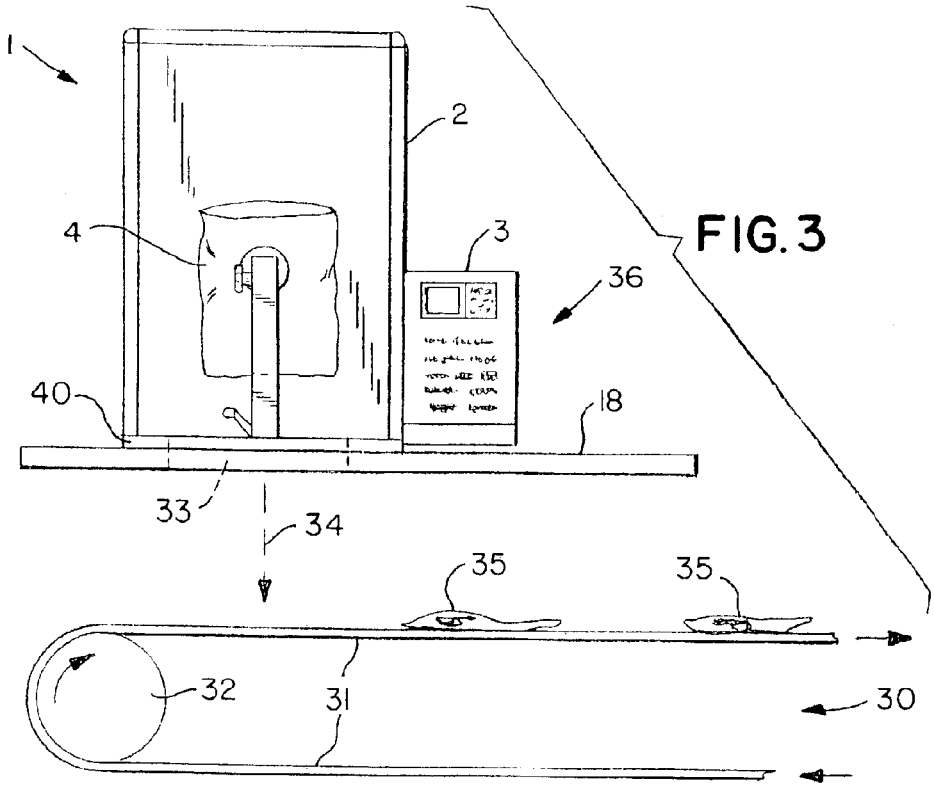
FIG. 3
FIG. 5
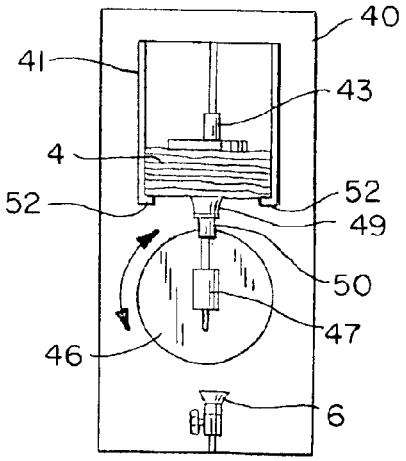
FIG. 6
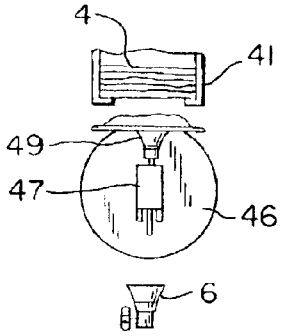

FIG. 8
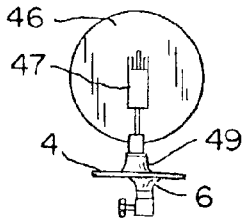
FIG. 9
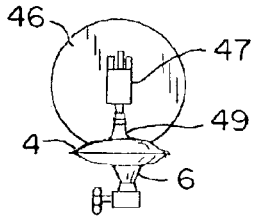
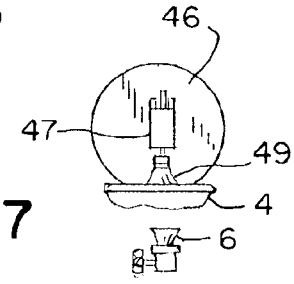
FIG. 7
FIG. 15
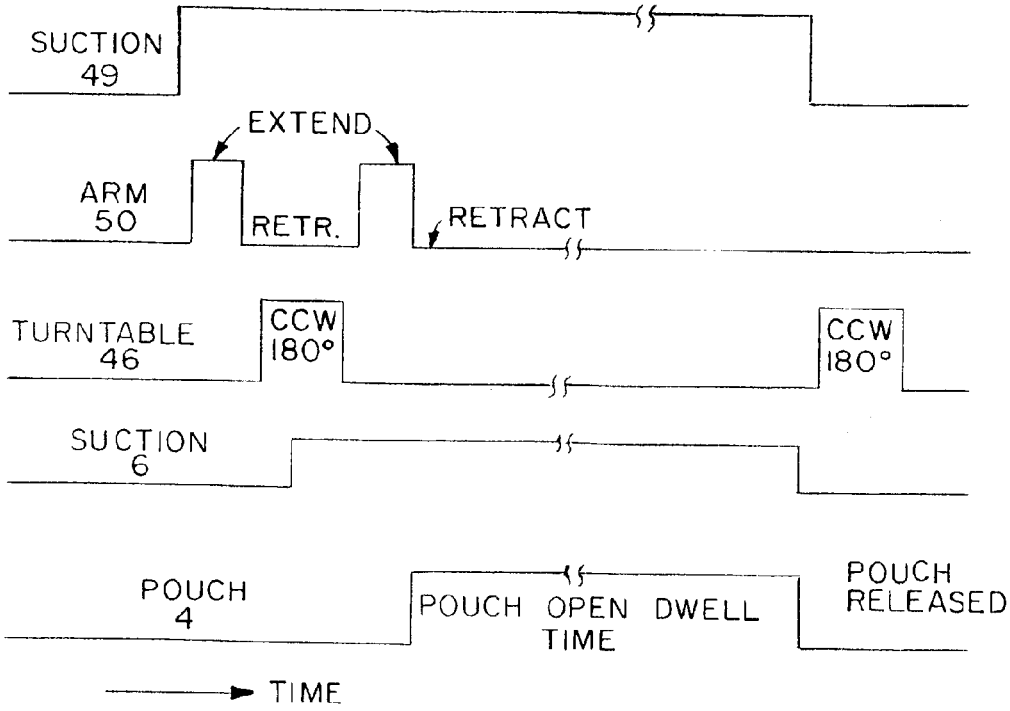

PORTABLE POUCH OPENING MACHINE

PRIORITY DATA

This application claims priority to the U.S. Provisional Application No. 60/382,056, filed May 21, 2002.

FIELD OF THE INVENTION

The present invention relates to portable accurate pouch openers for inserting products therein.

BACKGROUND OF THE INVENTION

Pouch and bag openers are known for insertion of products. However, these stationary bag openers are often complicated and bulky, and not portable.

These complicated and bulky pouch and bag opening machines can be useful for packaging of pre-measured liquid or solid food products from automated dispensers which control the exact amount of food introduced into the package.

However, in manufacture of small medical devices, the product to be inserted is often a single discrete, specially manufactured device such as a syringe, a patient monitoring device or a precision single use surgical or dental tool. There are occasions when more than one device will need to be inserted, or one or more devices will need to be inserted with other components, desiccants, instructions, etc. They are often transported manually during manufacture and sterilization, and are not conducive to insertion by complicated bulky packaging machines at a single location in a manufacturing facility.

In the absence of complicated, costly bulky stationary packaging devices, especially in small medical device manufacturing facilities, the pouches for holding single items are manually opened and sealed, often increasing the risk of repetitive stress injuries, such as carpal tunnel syndrome, to the employees conducting the pouch opening and insertion of products therein.

In addition, the use of complicated and bulky stationary pouch and bag openers prevents their portability, which restricts their use in different locations of a manufacturing facility. These stationary machines can't be readily moved between operator. stations.

Moreover, the permanently installed, bulky pouch opening machines cannot be moved to other locations, such as at facilities of remote contractors manufacturing parts for insertion into the pouches.

Among related patents include U.S. Pat. No. 2,601,480 of Williams for a frame mounted bag opening and spreading mechanism which uses puffs of air to open the bags, U.S. Pat. No. 2,732,988 of Feinstein for a base-mounted multi-mechanism packing and sealing apparatus, U.S. Pat. No. 2,969,629 of Blais for a multi-slotted packaging apparatus for bales of smaller boxes, U.S. Pat. No. 2,973,612 of McGowan for a multi-gear, multi-pulley bag opener mechanism with a mechanical funnel skirt made of two pivotable skirt halves and U.S. Pat. No. 3,225,515 of Inglett for an automated bag hanger.

Other related patents include U.S. Pat. Nos. 3,243,937 of Ragan and U.S. Pat. No. 3,495,378 of Kipers, both for bag openers having a plurality of bag opening elements on a continuous belt, U.S. Pat. No. 3,896,605 of Chevalier for a bag opener with moving jaws, U.S. Pat. No. 3,990,216 of Martin for a post mounted bag feeder and closer using fluid pressurized clamps, U.S. Pat. No. 4,057,951 of Schneider for a cam and gear controlled packaging machine for filling food packages and U.S. Pat. No. 4,078,358 of Henderson for a floor mounted bag transporter and filler.

U.S. Pat. No. 4,172,349 of Lipes discloses a bagging machine having a mechanical retractor for opening a bag and U.S. Pat. No. 4,509,313 of Koppe describes a pouch forming and filling apparatus which synchronizes the filling of pouches from a plurality of product dispensing funnels and the sealing of the filled bags.

Other patents include U.S. Pat. No. 4,554,776 of Chikatani for a floor mounted filling and binding packaging machine, U.S. Pat. No. 5,351,465 of Fortnam for a bag opener with arcuate strip springs which spread apart, U.S. Pat. No. 5,442,898 of Gabree and U.S. Pat. No. 6,263,645 of Burford for openers and fillers for bags which use the pressurized force of air jets to open the bags, U.S. Pat. No. 5,802,817 of Hood for an opener and filler for a wicketed bag which uses a pressurized fluid to open the bags and U.S. Pat. No. 6,318,051 of Preiss for an inserter mechanism for inserting individual pills into plastic blister packs for single dosages.

However, these generally bulky, complicated stationary prior art devices do not describe portable devices which can be easily set up for insertion of single discrete, specially manufactured devices which can be moved between operator stations to fit the rapidly changing needs of manufacturers, especially in the specialty medical manufacturing field at variable locations, both on and off site.

OBJECTS OF THE INVENTION

It is therefore an object of the present invention to provide a portable, micro-sized pouch opening device which can be easily set up for insertion of single discrete, specially manufactured devices, wherein the machine can be moved between operator stations to fit the rapidly changing needs of manufacturers, especially in the specialty medical manufacturing field at variable locations, both on and off site.

It is also an object of the present invention to prevent repetitive stress injuries for workers involved in insertion of single use pouches.

Other objects which become apparent from the following description of the present invention.

SUMMARY OF THE INVENTION

In keeping with these objects and others which may become apparent, this invention is a light weight (approximately 25 pounds or 11 kg) machine that is designed for desktop or bench use. It is ideally suited for use in clean rooms although industrial environments are also well served. This portable pouch-opening machine automatically opens three-sided flat envelopes one at a time. It can handle a variety of pouch materials including foil, Tyvek, paper, and plastic film. Pouch sizes from 2.5" to 8" (6 to 20 cm) in width and 4" to 12" (10 to 30 cm) tall can be accommodated.

With this machine, an operator simply drops in an item into an open pouch (even with a gloved hand) with no fumbling. Using a foot pedal can control manual initiation of each opening cycle. Alternatively, an automatic mode can be selected that keeps a pouch open for a fixed user-selected dwell period after which the pouch is released. Since the cycle time for handling a pouch from magazine to opening is less than two seconds, an operator can routinely handle auto-mode rates of 900 pouches per hour. After filling, a pouch can be manually set aside or sealed by a separate sealer unit.

A drop-through mode can also be set up whereby the filled pouch simply drops through a slot beneath into a chute or onto a conveyor belt. This mode is also compatible with robotic filling by a coordinated pick-and-place robot.

Reliable operation at low product cost is achieved through the use of a simple mechanical design driven by pneumatic or electric actuators under programmable control.

The portable, micro-sized pouch opening device can be easily set up for insertion of single discrete, specially manufactured devices which can be moved between operator stations to fit the rapidly changing needs of manufacturers, especially in the specialty medical manufacturing field at variable locations, both on and off site.

There are occasions when more than one device will need to be inserted, or one or more devices will need to be inserted with other components, desiccants, instructions, etc.

The portable, micro-sized pouch opening device works to reduce the occurrence of repetitive stress injuries for workers involved in insertion of single use pouches.

The small size of the device greatly enhances its portability both on and off site of a specialty manufacturing facility, while maintaining its utility as an effective pouch opener.

The use of drop-through options for automatic drops of filled pouches into a chute or conveyor provides versatility, which promotes its effective use.

The important synchronized pouch opening function of the lightweight device is maintained with the micro-size and portability of the device. The synergistic combination of the simple pouch opener with portability provides beneficial effects that are not possible with any other type of bulky, or complicated stationary pouch opener.

In the preferred embodiments, the present invention includes a lightweight, portable pouch-opening machine for in use on work surfaces, such counter tops, tables and cabinetry. The operator drops an item into an open pouch, which is opened by the machine of the present invention. A housing portion of the machine accommodates a plurality of pouches in a compartment, such as a magazine, along with apparatus to detach them one at a time and deliver them to the front operator interface area.

A controller is preferably supplied with electrical power and with compressed air for effectuating vacuum openings of the pouches. The pouch-opening machine can have an automatic mode for machine-paced operations or a manual mode for intermittent use.

One or more suction cups move from a first position where they contact and pull a pouch from the pre-opening storage compartment to a second position where a second set of one or more suction cups contacts a reverse side of the bag.

The opposing suction cups can be in a slightly staggered relationship, so that they don't lock in place in exact positional register with each other. For example, in one embodiment, the opposing cups can be offset in both a vertical and lateral direction, although other staggered positions can apply.

In the optional drop-through installation a slot is provided in the work surface so that released filled pouches can drop through onto a transporter, such as a conveyor belt or into a chute or bin.

The closed pouches to be opened are urged forward from the storage compartment by a pusher, such as, for example, a spring or by gravity in certain orientations.

When the individual pouch is grabbed from the mouth of the storage compartment by the set of movable one or more suction cups, the pouch and suction cups or cups are transported to the pouch opening location having the staggered opposite set of one or more suction cups. While any kind of transporter can be used, preferably the transporter is a rotatable turntable moving the pouch over an arc from a first suction-cup engaging location from inside the housing compartment to a second pouch opening location. However other configurations are possible, such as along partial arcuate movement or a linear movement to the second location, such as with a linear slide mechanism or linear roller mechanism.

When suction is removed from the one or more cups, the pouch is discharged for manual or automatic removal, and the transporter returns to the first location to begin again a pouch opening sequence.

It is further noted that in an alternate embodiment the portable desktop bench housing is rotatable, upon a desktop counter workspace, so that the magazine can orient the bags outward in a variety of orientations to the suction devices. Likewise, the suction devices can have differing orientations of a plurality of orientations for the pouches to be opened, such as in vertical or horizontal orientations.

OPERATION

Field testing of the lightweight portable micro-sized pouch opener of the present invention demonstrates significant improvements in worker safety ergonomics and productivity.

User friendly and typically weighing less than twenty-five pounds, the pouch opener permits a new operator with minimal training to be as fast as a seasoned operator with years of experience.

BRIEF DESCRIPTION OF THE DRAWINGS

The present invention can best be understood in connection with the accompanying drawings. It is noted that the invention is not limited to the precise embodiments shown in the drawings, in which:

FIG. 3 is a Front elevation view thereof of a drop-through installation using a belt conveyor;

FIG. 5 is a Top plan view of the machine thereof with the housing removed showing a movable suction cup in contact with a pouch in the pouch accommodating magazine;

FIG. 6 is a Top plan view detail showing the position just after pouch is pulled off magazine;

FIG. 7 is a Top plan view detail showing after the pouch is rotated to the user interface position;

FIG. 8 is a Top plan view detail of a pouch extended to contact with a fixed vacuum cup;

FIG. 9 is a Top plan view detail of an open pouch after the movable suction cup is pulled back;

FIG. 15 is a Timing chart of one complete machine cycle of this invention;

DETAILED DESCRIPTION OF THE INVENTION

Figure 1:
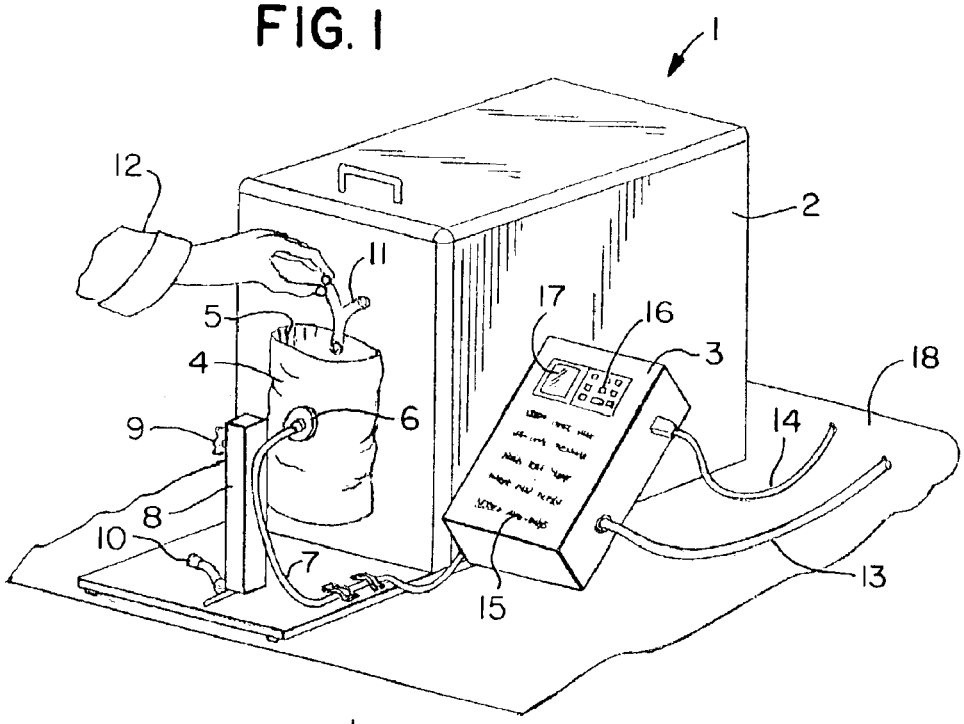
FIG. 1 is a Perspective view of portable pouch opening machine of this invention.

The present invention has broad applications to many technical fields for opening pouches for a variety of articles. For illustrative purposes only, a preferred mode for carrying out the invention is described herein, wherein FIG. 1 shows portable pouch-opening machine 1 in use on counter top 18. An operator's gloved hand 12 is shown dropping item 11 into an open pouch 4. Housing 2 encloses a supply of pouches 4 in a magazine along with apparatus to detach them one at a time and deliver them to the front operator interface area; this is done under the supervision of controller 3. Controller 3 is supplied with electrical power via cord 14 and compressed air (60 psig or 4.1 Bars) via line 13; it has a display 17 such as a liquid crystal display (LCD) for status communications, a keypad 16 for entering mode parameters, and written operator instructions 15 on its cover. Column 8 is adjusted and locked in its fore and aft travel by clamp 10; it supports suction cup 6, which is vertically adjusted via hand wheel 9. Suction cup 6 is supplied via suction line 7 from controller 3, and its function is to create top opening 5 in pouch 4.

Figure 2:
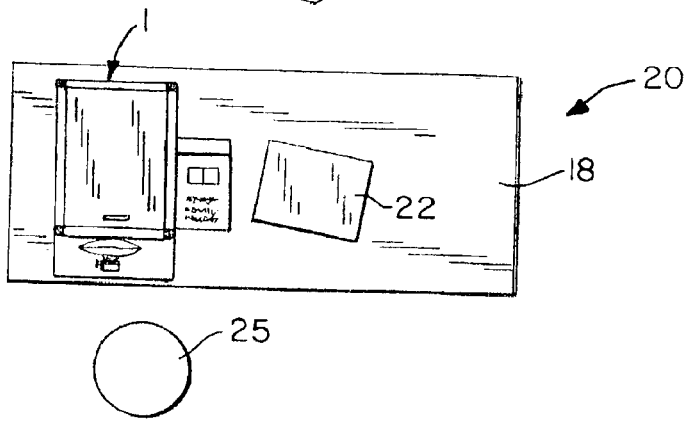
FIG. 2 is a Top plan view of a typical workstation thereof.

FIG. 2 shows a top view of a typical operator station 20 with pouch opening machine 1 and sealer 22 (optional) on table top 18, and stool 25 adjacent.

In drop-through installation 36 shown in FIG. 3, a slot 33 is provided in table top 18 and base 40 so that released filled pouches 35 can drop through onto conveyor belt 31 which is driven by pulley 32. The conveyor can be replaced by a chute or bin as appropriate.

Figure 4:
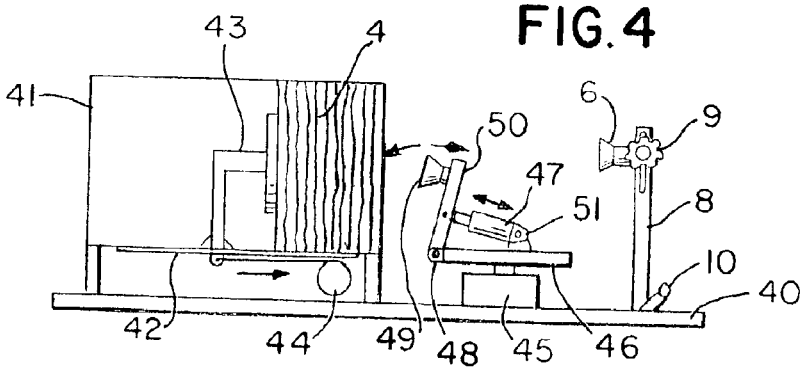
FIG. 4 is a Side elevation view of the pouch-opening machine of this invention with the housing removed and side panel of the pouch magazine removed.

FIG. 4 is a side view of pouch opening machine 1 with the housing removed. Pouch magazine 41 is shown without it proximal side panel to reveal pouches 4 being urged forward (to the right) under the influence of pusher 43 which rides in linear guide 42 and is attached to the end of constant force spiral spring 44 supplying the force. Turntable 46 is attached to pneumatic rotary actuator 45; it supports bar 50, which pivots at 48 and supports movable suction cup 49 at its distal end. Pneumatic cylinder 47 pivotally attached to turntable 46 at 51 operates the position of vacuum cup 49 over an arc as shown, such that cup 49 can contact the surface of the outer pouch 4 in magazine 41 when cylinder 47 piston is extended.

FIGS. 4 through 9 show a sequence of operations resulting in an open pouch being presented to the user. FIG. 15 is a timing diagram related to this sequence of FIGS. 4–9.

In the top view of FIG. 5, cylinder 47 has extended suction cup 49 to contact and thereby adhere to the surface of outer pouch 4 which is held back by edge fingers 52.

FIG. 6 shows pouch 4 extracted from magazine 41 through fingers 52 when cup 49 is quickly withdrawn under the influence of cylinder 47.

Turntable 46 is then rotated 180° counterclockwise to end up as shown in FIG. 7 with a single pouch 4 attached (but still closed) facing the user; note the gap between the surface of pouch 4 and stationary vacuum cup 6.

FIG. 8 shows the instant when cup 49 (with pouch 4) is extended so that the proximal surface of pouch 4 contacts vacuum cup 6.

As shown in FIG. 9, it is then quickly retracted to open pouch 4. When suction is removed from cups 49 and 6, pouch 4 is released; then turntable 46 is rotated 180° clockwise in position for the next opening cycle.

In these Figures, cup 49 and cup 6 are shown to be slightly offset in both a vertical and lateral direction. This is important for proper operation to separate the two faces of pouch 4. Also, more than one physical cup can be used as appropriate as a substitute for the single cup 49 and single cup 6 shown in the figures.

Figure 10:
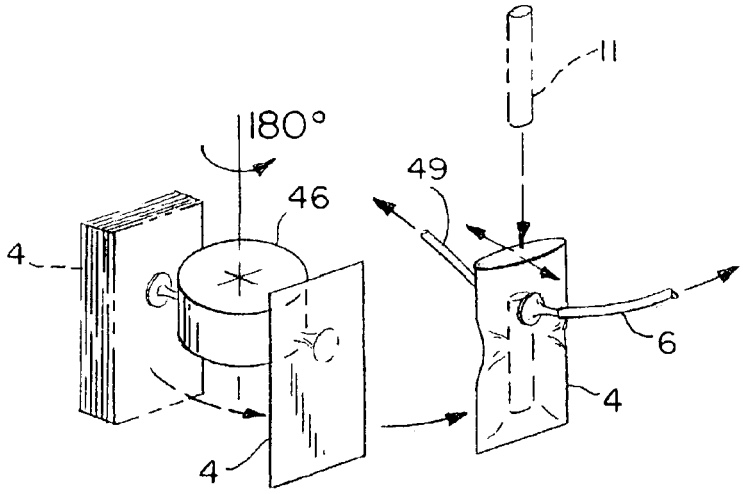
FIG. 10 is a diagrammatic perspective view of the embodiment for dispensing the pouches 180° from a vertical stacked storage orientation, to a vertical opening and filling orientation, as in FIGS. 1–9.

FIG. 10 is a diagrammatic perspective view of the embodiment for dispensing the pouches 180° from a vertical stacked storage orientation, to a vertical opening and filling orientation, as in FIGS. 1–9.

While FIGS. 1–10 show the 180° orientation of the pouch from a vertical storage position to a vertical opening and filling position, other orientations may be provided.

Figure 11:
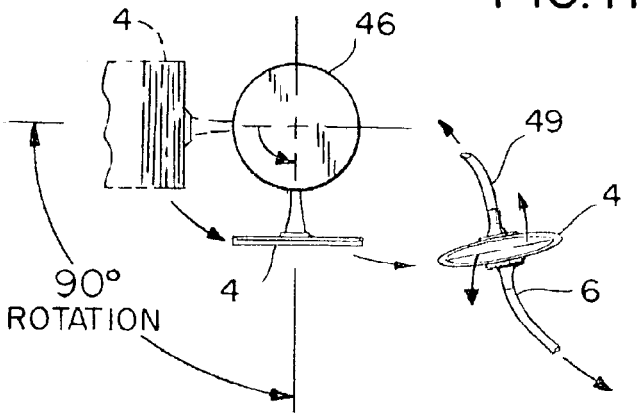
FIG. 11 is a diagrammatic top plan view of an alternate embodiment for dispensing the pouches 90° from a vertical stacked storage orientation to a vertical opening and filling orientation.

For example, FIG. 11 is a diagrammatic top view of an alternate embodiment for dispensing the pouches at an angle less than 180°, such as for example, 90°, from a vertical stacked storage orientation to a vertical opening and filling orientation.

Figure 12:
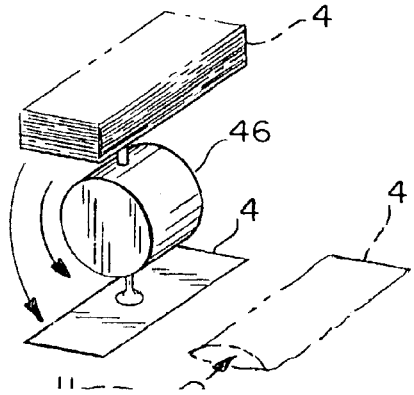
FIG. 12 is a diagrammatic perspective view of a further alternate embodiment for dispensing the pouches 180° from a horizontal stacked storage orientation to a horizontal opening and filling orientation.

FIG. 12 is a diagrammatic perspective view of a further alternate embodiment for dispensing the pouches 180° from a horizontal stacked storage orientation to a horizontal opening and filling orientation.

Figure 13:
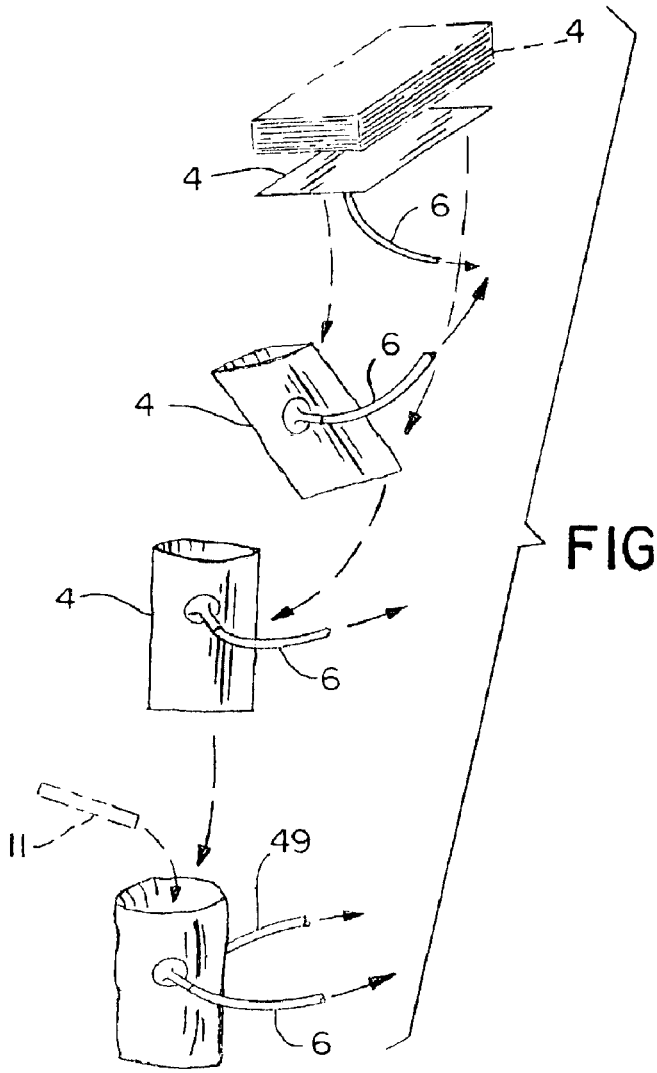
FIG. 13 is a diagrammatic perspective view of a further alternate embodiment for dispensing the pouches 90° from a horizontal stacked storage orientation downwardly to a vertical opening and filling orientation.

FIG. 13 is a diagrammatic perspective view of a further alternate embodiment for dispensing the pouches 90° from a horizontal stacked storage orientation downwardly to a vertical opening and filling orientation.

Figure 14:
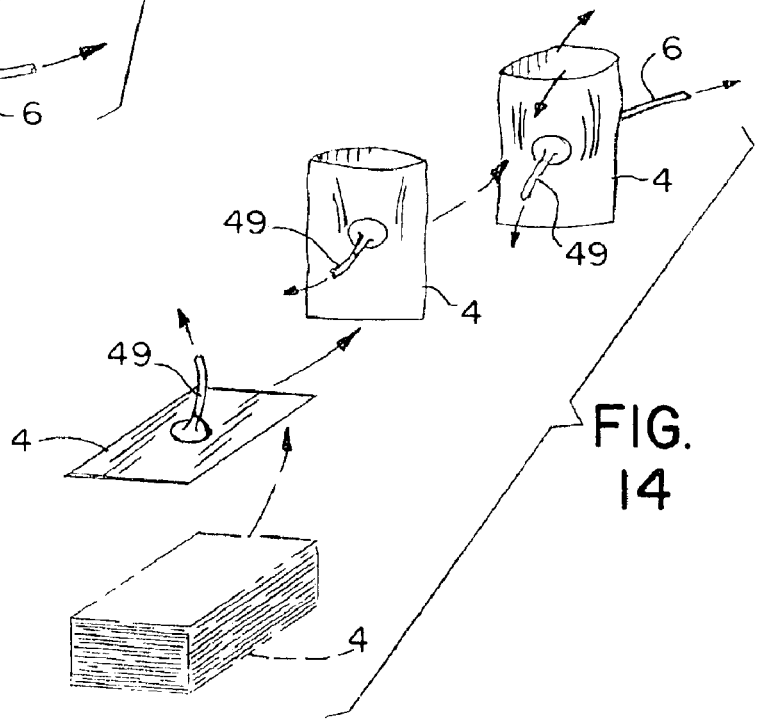
FIG. 14 is a diagrammatic perspective view of yet another alternate embodiment for dispensing the pouches 90° from a horizontal stacked storage orientation upwardly to a vertical opening and filling orientation.

FIG. 14 is a diagrammatic perspective view of yet another alternate embodiment for dispensing the pouches 90° from a horizontal stacked storage orientation upwardly to a vertical opening and filling orientation.

FIG. 15 is a Timing chart of one complete machine cycle of this invention, wherein elapsed time is indicated from left to right.

Figure 16:
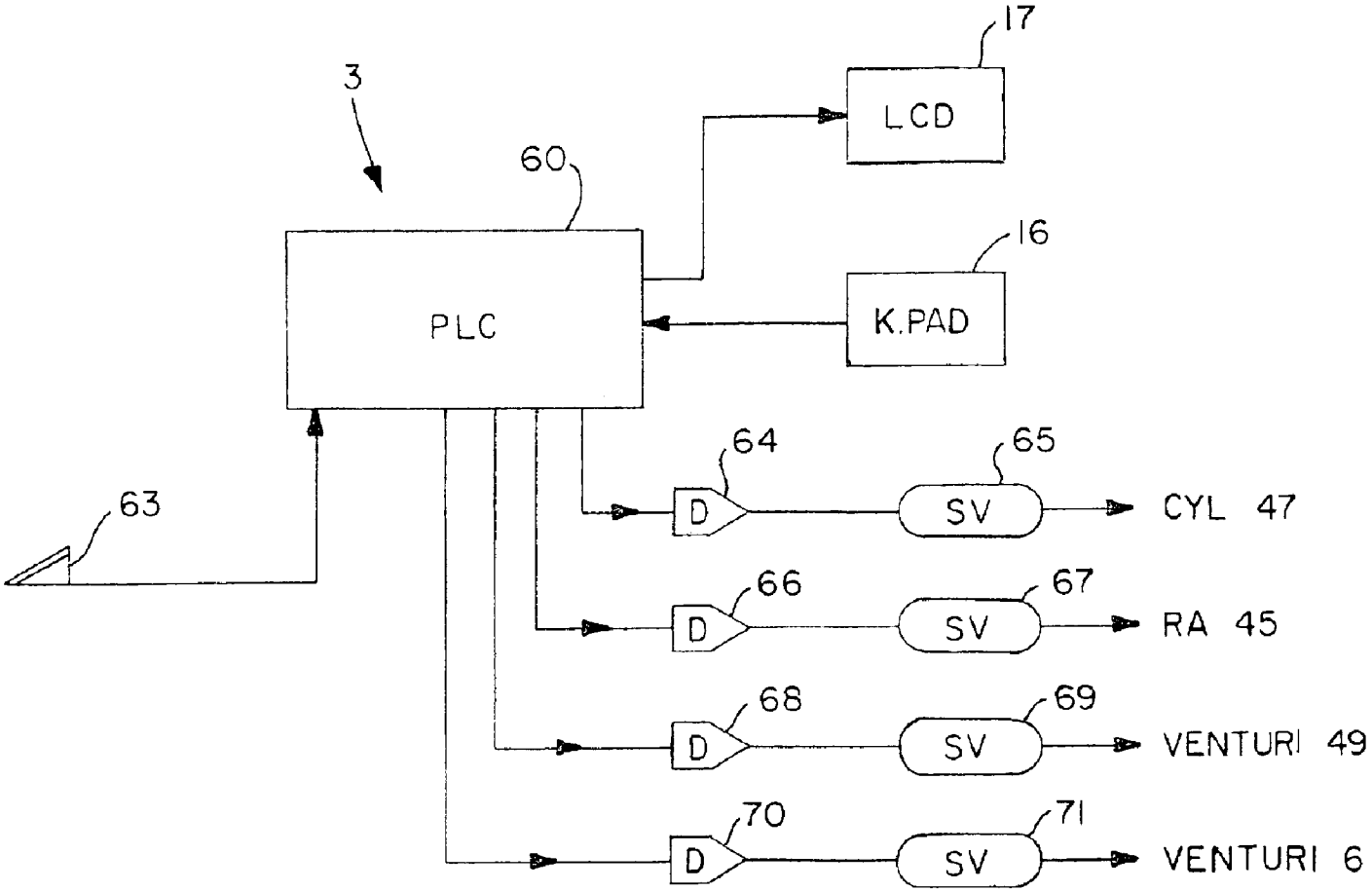
FIG. 16 is a High level block diagram of the pouch opening machine of this invention.

FIG. 16 is a block diagram of controller 3. A programmable logic controller (PLC) 60 or microprocessor is used to coordinate the operation of the various components. An optional foot pedal 63 is used for manual control of the timing when that mode is selected from the options via keypad 16. Four drivers and solenoid valves are controlled by PLC 60. Driver 64 drives valve 65 to control the position (extend or retract) of cylinder 47. Solenoid valve 67 is driven by driver 66 to control the position of turntable 46 via rotary pneumatic actuator 45. Driver 68 controls valve 69 to control passage of compressed air to a venturi, which supplies vacuum to suction cup 49. Driver 70 controls valve 71 to control passage of compressed air to another venturi, which supplies vacuum to suction cup 6. Alternatively, PLC 60 can control electrically driven vacuum generators directly instead of using venturis.

It is understood that alternative mechanisms may be used to impart the motions required. Well known substitutions include pneumatic bellows or diaphragms for pneumatic cylinder 47, or even an electric solenoid can be used. Pneumatic rotary actuator 45 can be replaced by a stepper motor or rotary solenoid.

Figure 17:
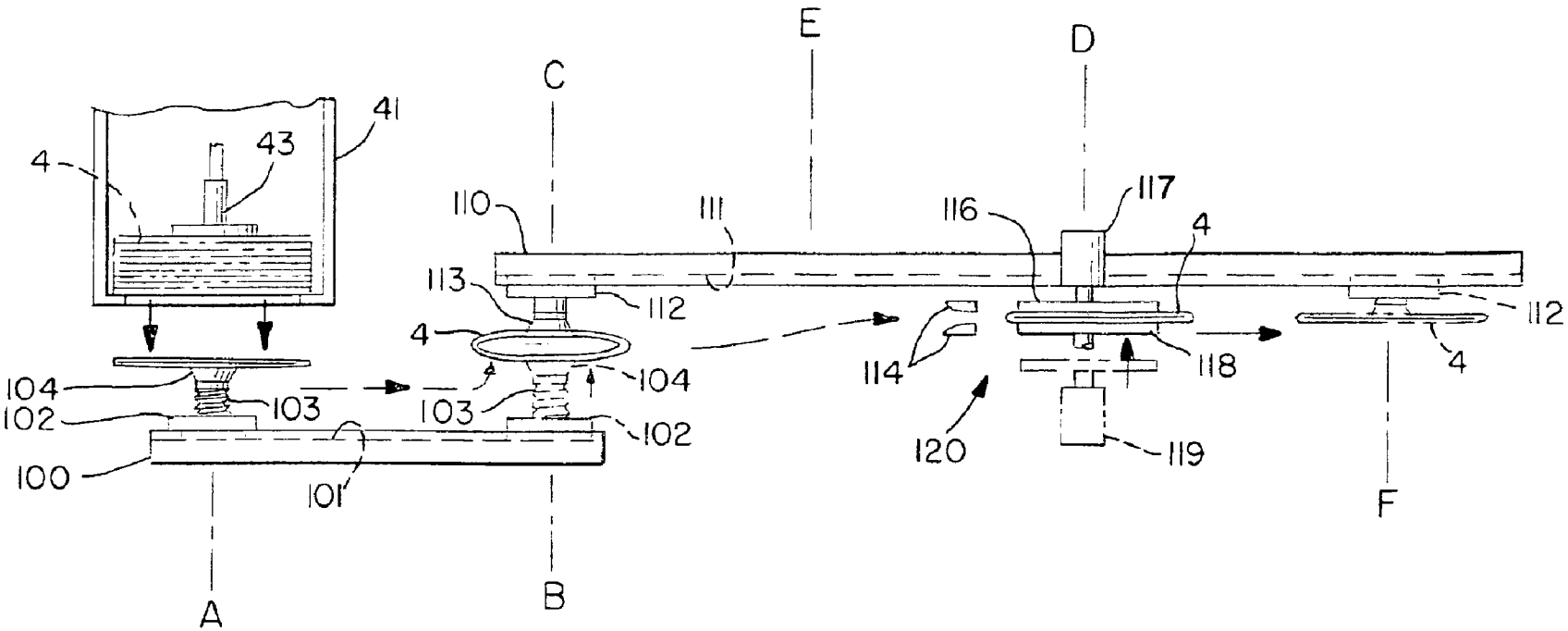
FIG. 17 is a side elevation of alternate embodiment of portable pouch opening machine using linear slide mechanisms.

The alternate embodiment of FIG. 17 uses two linear slide mechanisms to move pouches 4 with linear motions to accomplish the same task, with the additional feature of heat sealing the filled pouch. These linear slides can use a variety of drive mechanisms. They can use pneumatically driven rodless cylinders, or stepper motors can drive them via timing belts or lead screws. Linear slide 100 incorporating rail 101 and slide member 102 is used to convey pouches 4 from magazine 41 at A to opening station at B. Linear slide 110 incorporating rail 111 and slide member 112 conveys pouch 4 from opening station at C through heat sealer 120 at D. Heat sealer 120 consists of guidance lips 114, heat bar 116 with linear actuator 117, and heat bar 118 with linear actuator 119. Suction cup 104 is attached to linear actuator 103, which is depicted as a pneumatic bellows; it can also be implemented as a short pneumatic cylinder, a pneumatic diaphragm, or a linear solenoid. Suction cup 113 is attached to slide 112.

The operation starts with slide 102 at A and slide 112 at C. Vacuum is started at suction cup 104, and 103 is extended to contact bottom pouch 4. 103 is contracted thereby drawing pouch 4 from magazine 41. Still attached to suction cup 104, pouch 4 is moved to the right via slide 102 to position B. Vacuum is started at 113 and 103 is extended to attach the distal face of pouch 4 to suction cup 113. Upon contraction of 103, pouch 4 is opened. Item is then inserted in pouch 4. Vacuum is shut off at 104 releasing it from pouch 4. Simultaneously, slide 102 is moved left to A and slide 112 carrying pouch 4 via suction cup 113 is moved right through area E to position D, positioning the open edge of pouch 4 within heat sealer 120 between heat bars 116 and 118. Actuators 117 and 119 cause heat bars 116 and 118 to clamp down on edge sealing pouch 4. After heat bars 116 and 118 are again withdrawn, slide 112 is moved forward to position F carrying sealed filled pouch 4. Vacuum on suction cup 113 is removed thereby releasing pouch 4 to drop. Then slide 112 is moved back left to position C.

In an alternate embodiment (not shown), the heat sealed pouch 4 can be retracted back from heat bars 116 and 118 of heat sealer 120 toward area E for dispensing.

Figure 18:
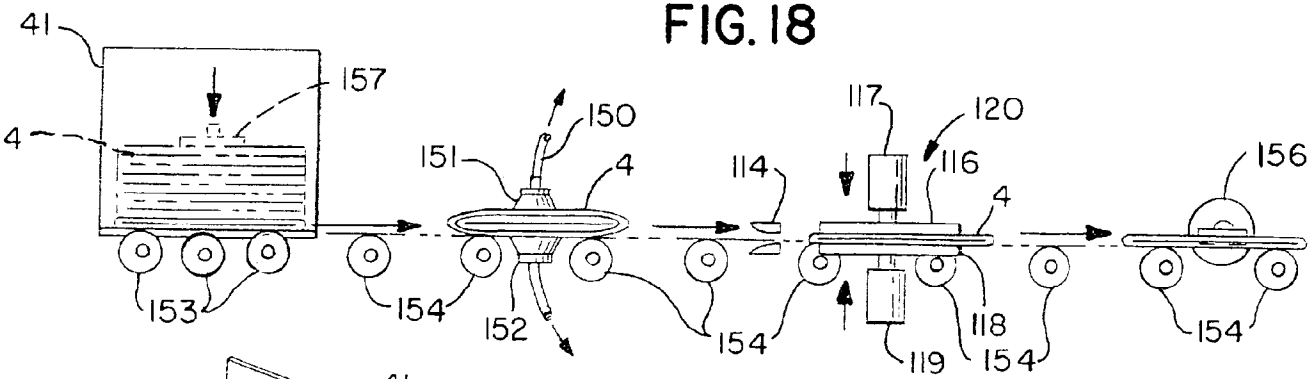
FIG. 18 is a Side elevation of an alternate embodiment of this invention using linear movement of pouches incorporating friction wheels and conveyor rollers; and, FIG. 19 is a perspective view of the embodiment of FIG. 18.
Figure 19:
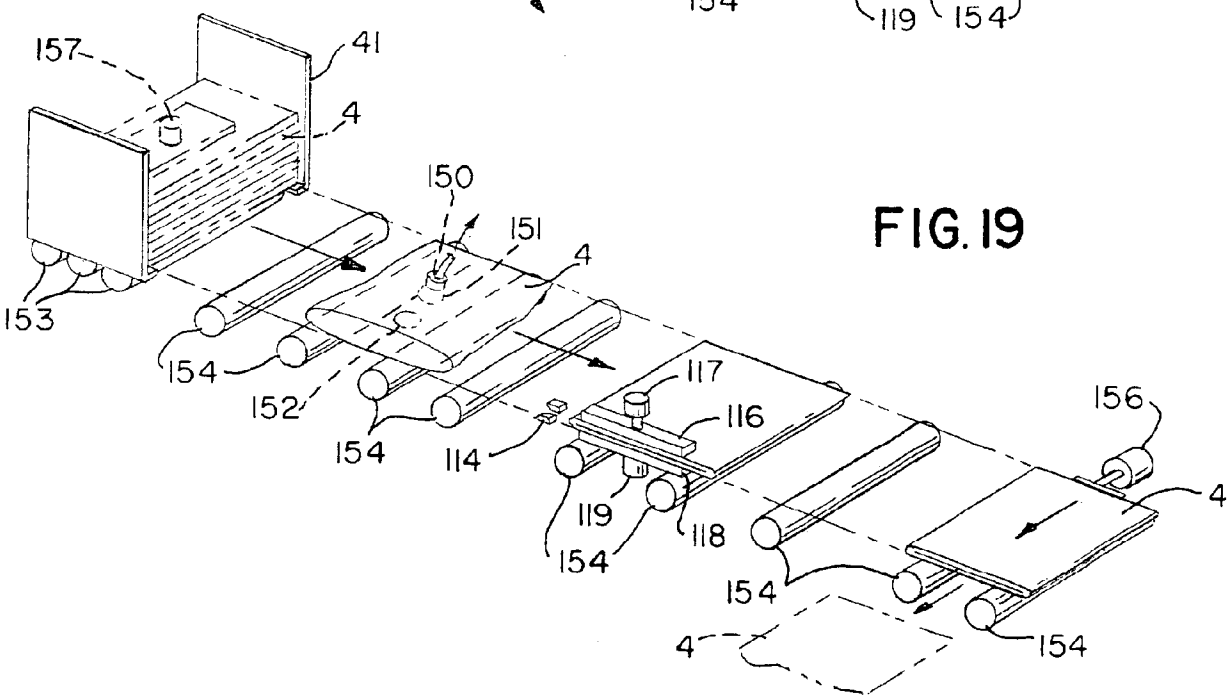

FIGS. 18 and 19 illustrate another linear motion embodiment of this invention. Instead of linear slide mechanisms, friction wheels and miniature conveyor rollers are used to move pouch 4 through a sequence similar to that of FIG. 17. Here, unidirectional friction wheels 153 are powered for a short period to move a single pouch 4 from the bottom of magazine 41 to the opening station directly over stationary suction cup 152. At this position, vacuum is applied to both suction cups 152 and 151 and linear actuator 150 moves suction cup 151 to contact the top face of pouch 4, and then retracts to its raised position thereby opening pouch 4. The object is then inserted in pouch 4 and unidirectional conveyor rollers 154 are energized to move pouch 4 to the right. Bi-directional rollers 155 are rotated clockwise to convey pouch 4 all the way to the right positioning open edge within heat bars 116 and 118 of heat sealer 120. After the heat sealing cycle, rollers 154 continue to turn long enough to convey filled sealed pouch 4 to the right in registration with pusher actuator 156 which is then energized to extend thereby pushing pouch 4 orthogonal to conveyor movement causing it to drop down into a collection bin (not shown). Actuator 156 is then retracted after pushing filled and sealed pouch 4 off the conveyor way. The described cycle then repeats. While heat sealer 120 is shown as an option to the linear roller embodiment of FIGS. 18 or 19, it can also optionally be added to the turntable embodiment of FIGS. 1–9 or the linear slide mechanism of FIG. 17.

In another alternate embodiment, after the heat sealing cycle, rollers (not shown) would be bi-directional, and would be turned counter-clockwise long enough to convey filled sealed pouch 4 to the left in registration with a pusher actuator (not shown) which is then energized to extend thereby pushing pouch 4 orthogonal to conveyor movement causing it to drop down into a collection bin (not shown).

While heat sealer 120 is shown as an option to the linear roller embodiment of FIGS. 18 or 19, it can also optionally be added to the turntable embodiment of FIGS. 1–9 or the linear slide mechanism of FIG. 17.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing from the scope of the invention.

I claim:

1. A portable desktop method of opening and filling a bag comprising the steps of:

providing rotatable portable desktop bench housing, upon a desktop counter workspace, said housing having a retractable storage magazine for insertable bags, a first suction device mounted on a turntable and a second suction device, said suction devices engagable with a vacuum;

orienting said rotatable portable desktop bench housing upon said desktop counter workspace;

inserting a plurality of bags in a predetermined loading orientation in the storage magazine;

advancing said first suction device to contact one wall of a bag while applying said vacuum to said first suction device so that said one wall of said bag becomes engaged to said first suction device;

rotating said turntable to reorient said first suction device in a further orientation with said bag attached to face said second suction device being actuated by said vacuum;

advancing said first suction device toward said second suction device until a facing wall of said bag is in contact with and engaged by said second suction device;

retracting said first suction device to separate said walls of said bag to produce an opening into said bag;

depositing an object into said bag through said opening;

terminating vacuum to at least one of said suction devices resulting in said bag closing; and, releasing said bag.

2. The method of claim 1 in which said first and second suction devices are suction cups.

3. The method of claim 1 in which said first and second suction cups are aligned with each other when in contact with oppositely facing sides of said bag.

4. The method of claim 1 in which said bag is removed from a magazine by said first suction device and said first suction device is reoriented to engage another bag in said magazine after releasing said bag.

5. A method of opening and filling bags comprising the steps of:

providing rotatable portable desktop bench housing, upon a desktop counter workspace, said housing having a retractable storage magazine for insertable bags, a first suction device mounted on a turntable and a second suction device, said suction devices engagable with a vacuum;

orienting said rotatable portable desktop bench housing upon said desktop counter workspace so that said bag storage magazine is oriented in a first predetermined orientation of a plurality of orientations;

inserting a plurality of bags in said predetermined loading orientation in the storage magazine;

advancing said first suction device to contact one wall of a bag in a magazine containing a supply bags while applying said vacuum to said first suction device so that said wall of said bag becomes engaged to said first suction device;

rotating said turntable to reorient said first suction device in a further orientation with said bag attached to face said second suction device being actuated by said vacuum;

advancing said first suction device toward said second suction device until a facing wall of said bag is in contact with and engaged by said second suction device;

retracting said first suction device to separate said walls of said bag to produce an opening into said bag;

depositing an object into said bag through said opening;

closing and releasing said bag to a conveyer system; and rotating said turntable to reorient said first suction device to withdraw another bag from said magazine.

6. A method of opening and filling a bag comprising the steps of:

providing a portable housing upon a desktop bench workspace, a first suction device mounted on a turntable, and a second suction device;

advancing said first suction device to contact one wall of said bag while applying a vacuum to said first suction device so that said one wall of said bag becomes engaged to said first suction device;

rotating said turntable to reorient said first suction device with said bag attached to face a second suction device being actuated by a vacuum;

advancing said first suction device toward said second suction device until an opposite facing wall of said bag is in contact with and engaged by said second suction device;

retracting said first suction device to separate said walls of said bag to produce an opening into said bag;

depositing an object into said bag through said opening;

closing said bag by terminating vacuum to at least one of said suction devices; and releasing said bag.

7. The method of claim 6 in which said first and second suction devices are suction cups.

8. The method of claim 6 in which said first and second suction cups are aligned with each other when in contact with oppositely facing sides of said bag.

9. The method of claim 6 in which said bag is removed from a magazine by said first suction device and said first suction device is reoriented to engage another bag in said magazine after releasing said bag.

10. A method of opening and filling bags comprising the steps of:

providing a portable housing upon a desktop bench workspace, a first suction device mounted on a turntable, and a second suction device;

advancing said first suction device to contact one wall of a bag in a magazine containing a supply of bags while applying a vacuum to said first suction device so that said wall of said bag becomes engaged to said first suction device;

rotating said turntable to reorient said first suction device with said bag attached to face a second suction device being actuated by a vacuum;

advancing said first suction device toward said second suction device until an opposite facing wall of said bag is in contact with and engaged by said second suction device;

retracting said first suction device to separate said walls of said bag to produce an opening into said bag;

depositing an object into said bag through said opening;

closing and releasing said bag to a conveyer system; and rotating said turntable to reorient said first suction device to withdraw another bag from said magazine.

11. A portable rotatable desktop apparatus for opening and filling a bag comprising:

a portable rotatable desktop bench housing;

said housing having a magazine containing a supply of bags in an orientation to be opened and filled;

a first suction device rotatably mounted on a turntable for being moved into engagement with a bag in said magazine, said first suction device having a source vacuum to activate said first suction device when placed into contact with one wall of said bag;

means for withdrawing said first suction device to remove said bag from said magazine and, after rotation of said turntable, to place an opposite facing wall of said bag in contact with a second suction device, said second suction device having a source of vacuum, so that said opposite facing wall is engaged by said second suction device; and means for retracting said first suction device to separate said walls of said bag to produce an opening into said bag allowing said bag to be filled.

12. The apparatus of claim 11 in which said second suction device is stationary.

13. The apparatus of claim 11 in which said suction devices are suction cups.

14. The apparatus of claim 11 having means for controlling the sequence of operation of said suction devices, withdrawing means and retracting means.

15. Apparatus for opening and filling a bag comprising:

a portable housing positionable upon a desktop bench workspace;

a magazine containing a supply of bags to be opened and filled;

a first suction device rotatably mounted on a turntable for being moved into engagement with a bag in said magazine, said first suction device having a source of vacuum to activate said first suction device when placed into contact with one wall of said bag;

means for withdrawing said first suction device to remove said bag from said magazine and, after rotating said turntable, to place an opposite facing wall of said bag in contact with a second suction device, said second suction device having a source of vacuum, so that said opposite facing wall is engaged by said second suction device; and means for retracting said first suction device to separate said walls of said bag to produce an opening into said bag allowing said bag to be filled.

16. The apparatus of claim 15 in which said second suction device is stationary.

17. The apparatus of claim 15 in which said suction devices are suction cups.

18. The apparatus of claim 15 having means for controlling the sequence of operation of said suction devices, withdrawing means and retracting means.

* * * * *